US006460596B1

(12) United States Patent
Yamaguchi et al.

(10) Patent No.: US 6,460,596 B1
(45) Date of Patent: Oct. 8, 2002

(54) METHOD OF COATING POWDER LUBRICANT IN METALLIC INJECTION MOLDING MACHINE AND DIE USED OF METALLIC INJECTION MOLDING

(75) Inventors: Takeshi Yamaguchi, Hiroshima (JP); Hidenori Takayasu, Hiroshima (JP); Ryuichi Sakamoto, Hiroshima (JP); Tadayoshi Tukeda, Hiroshima (JP); Toshiyuki Tange, Hyogo (JP); Keiji Gohonjo, Hyogo (JP)

(73) Assignees: The Japan Steel Works, Ltd., Tokyo (JP); Hanano Corporation, Hyogo (JP)

( * ) Notice: Subject to any disclaimer, the term of this patent is extended or adjusted under 35 U.S.C. 154(b) by 0 days.

(21) Appl. No.: 09/693,957

(22) Filed: Oct. 23, 2000

(30) Foreign Application Priority Data

Oct. 21, 1999 (JP) ..... 11-299043

(51) Int. Cl.[7] ..... B05D 1/12; B22C 3/02

(52) U.S. Cl. ..... 164/72; 164/113; 164/267; 164/312

(58) Field of Search ..... 164/113, 312, 164/72, 267

(56) References Cited

U.S. PATENT DOCUMENTS 4,562,875 A * 1/1986 Ogoshi et al. ..... 164/72

5,979,535 A * 11/1999 Sakamoto et al. ..... 164/113

FOREIGN PATENT DOCUMENTS

| | | |
|---|---|---|
| DE | 100 22 328 A1 | 11/2001 |
| EP | 230 660 B1 | 3/1990 |
| EP | 983 812 A1 | 3/2000 |
| JP | 1-33541 | 7/1989 |
| JP | 2-15620 | 4/1990 |
| JP | 6-320246 | 11/1994 |
| WO | WO 93-01910 | 2/1993 |

* cited by examiner

*Primary Examiner*—Kuang Y. Lin
(74) *Attorney, Agent, or Firm*—Sughrue Mion, PLLC

(57) ABSTRACT

A method of coating a powder lubricant in a metallic injection molding machine having a die composed of a stationary die (2) and a movable die (10), a sprue hole (4), runner groove (5), gate hole (6) and cavity (7) being formed on parting faces (P) of these dies (2, 10), a cold plug catcher (13) communicating with the sprue hole (4) when the movable die (10) is fastened to the stationary die (2) being formed in the movable die, the method of coating a powder lubricant in a metallic injection molding machine comprising the step of coating the powder lubricant from the cold plug catcher (13) toward the cavity (7) by decompressing the inside of the sprue hole, runner groove, gate hole and cavity from the cavity side.

5 Claims, 3 Drawing Sheets

METHOD OF COATING POWDER LUBRICANT IN METALLIC INJECTION MOLDING MACHINE AND DIE USED OF METALLIC INJECTION MOLDING

BACKGROUND OF INVENTION

1. Field of Invention

The present invention relates to a method of coating a powder lubricant in a metallic injection molding machine having a die composed of a stationary die and a movable die, a sprue hole, runner groove, gate hole and cavity being formed on parting faces of these dies, molten metal being injected into the cavity via the sprue hole and runner groove so as to fill the cavity with the molten metal. Also, the present invention relates to a die used for metallic injection molding.

2. Related Art

As one of the high pressure casting methods of producing a metallic product from a low melting point metallic material such as aluminum, magnesium and zinc alloy, there is proposed a thixotropic molding method, which is disclosed in Japanese Examined Patent Publication Nos. 1-33541 and 2-15620. According to this method, a part is obtained as follows. When a raw material of alloy is agitated in a state in which solid and liquid are coexisting, the formation of dendrite is suppressed. Therefore, it is possible to obtain a slurry in which fine solid particles and liquid are coexisting. This semi-solid slurry is injected into a die in a short period of time and soldified. In this way, a part of alloy, in the microstructure of which solid is substantially uniformly distributed, can be obtained. Concerning the thus obtained molding, a ratio of contraction caused by solditication is low, and micro-shrinkage is small, that is, the number of trap holes is small and also the number of cavity holes caused by the contamination of gas is small. Therefore, the dimensional accuracy of the thus obtained part is high, and the mechanical property are excellent. An injection molding machine is used for the above method of manufacturing a molding of alloy in which the property of slurry is used. Briefly speaking, the injection molding machine is composed of a heating cylinder and a screw arranged in the heating cylinder, wherein this screw is capable of rotating in the rotational direction and driven in the axial direction. In general, an open type injection nozzle is provided in the front of the heating cylinder. In the outer peripheral sections of the heating cylinder and the injection nozzle, there are provided a plurality of heaters, the heating temperatures of which are individually controlled.

When molten metal is measured by an injection molding machine having an open type injection nozzle, it is necessary to set a plug in order to prevent the molten metal to be measured from leaking out from a forward end portion of the injection nozzle. A cold plug, which is formed when the molten metal is cooled and solidified to some extent, is used for this plug. The cold plug is formed as follows. After the shot, the injection nozzle coming into contact with the die is quickly deprived of heat, that is, heat is quickly conducted to the die. As a result, the molten metal staying at a forward end portion of the injection nozzle is solidified and the cold plug is formed. This cold plug is formed into such hardness that the cold plug can stand the pressure of molten metal, which is being measured, and also the cold plug can be drawn out when the injection pressure is given to it. Accordingly, when the screw is rotated, metallic slurry is successively conveyed to the forward end portion of the barrel. At this time, slurry is melted by the heat given from the heater around the barrel and also by the heat generated by the shearing and the frictional action when the screw is rotated. The thus slurry is stored in the measurement chamber provided in the forward end portion of the heating barrel. At this time, the sprue hole, runner groove and cavity are coated with a powder lubricant, and the screw is driven at high speed in the axial direction. Then, the slurry stored in the measurement chamber is injected into the cavity via the sprue hole, runner groove and gate hole and filled. At this time, the cold plug is caught by the cold plug catcher provided in the movable die. After the slurry has been cooled and solidified, the die is opened. Then, the part can be easily taken out from the die because the powder lubricant is coated inside the die. AT the same time, the sprue and runner are also discharged from the die.

On the other hand, another method of manufacturing a metallic mold is known which is a cold chamber type die casting method. As disclosed in Japanese Unexamined Patent Publication Hei. 6-320246, the die casting machine 50 used for this die casting method is composed as follows. As shown in FIG. 3, the die casting machine 50 includes: a stationary die 52 attached to the stationary base 51; a movable die 53 which composes a pair together with the stationary die 52; a sleeve 54 penetrating the stationary base 51; and a plunger 55 arranged in the sleeve 54 being capable of moving in the axial direction. In the sleeve 54, there is provided a molten metal supply port 56. This molten metal supply port 56 is closed by the shutter 57' when the powder lubricant is coated. The powder lubricant supply nozzle 57 is attached to this shutter 57'. When molten metal is poured into the sleeve 54, the powder lubricant supply nozzle 57 is retracted together with the shutter 57'. On the parting line between the stationary die 52 and the movable die 53, there is formed a cavity 60 for forming a part. The first exhaust passage 61 is open to an end portion of this cavity 60. The first exhaust passage 61 is opened and closed by the shut-off pin 63 driven by the hydraulic piston cylinder unit 62. The second exhaust passage 64 branches from the first exhaust passage 61 in such a manner that the second exhaust passage 64 makes a right angle with the first exhaust passage 61. Although not shown in FIG. 3, the second exhaust passage 64 is connected with a valve, vacuum tank and exhaust pump via the flexible hose 65. In this connection, the powder lubricant supply nozzle 57 is connected with a powder lubricant supply device, from which a predetermined quantity of powder lubricant is supplied by compressed air, via the flexible hose 58. This powder lubricant supply device is not shown in FIG. 3, either. The ejector plate and ejector pin are not shown in FIG. 3, either.

It is possible to obtain a part as follows by the die casting machine 50 which is composed as described above. As shown in FIG. 3, the movable die 53 is fastened to the stationary die 52, and the shut-off pin 63 is retracted as shown in FIG. 3. Then, the exhaust pump is driven. Then, air is discharged from the cavity 60, gate passage 66, sprue 67 and sleeve 54 into the vacuum tank. Due to the foregoing, the inside of each component is decompressed. At this time, the shutter 57', to which the powder lubricant supply nozzle 57 is attached, closes the molten metal supply port 56. Due to the foregoing, air is prevented from being sucked from a portion close to the molten metal supply port 56. Powder lubricant is supplied from the powder lubricant supply device by compressed air for a predetermined period of time. Therefore, the powder lubricant adheres onto the inner surfaces of the cavity and others. The shut-off pin 63 is driven by the hydraulic piston cylinder unit 62, so that the first exhaust passage 61 is closed. After that, a predetermined quantity of molten metal is supplied from a crucible into the sleeve 54 via the molten metal supply port 56. The thus supplied molten metal is injected into the cavity 60 by the plunger 55. When the movable die 53 is opened after the thus injected and charged molten metal has been cooled and solidified, the ejector protrudes and a part can be provided.

As described above, according to the metal injection molding machine, it is possible to obtain a part, the dimensional accuracy of which is high and the mechanical property of which is excellent. However, problems may be encountered in the method of coating a powder lubricant. Concerning these problems, there is shown a method of coating a powder lubricant in the above die casting machine 50. Therefore, when this powder lubricant coating method is applied, the problems may be solved. However, according to the powder lubricant coating method of the die casting machine 50, a surface of the cavity 60 is coated with the powder lubricant from the sleeve 54 fixed to the stationary base 51. Therefore, in the case of an injection molding machine, coating is conducted from the sprue hole. In order to conduct coating from the sprue hole, it is necessary to temporarily separate the injection nozzle from the die. In this connection, in order to separate the injection nozzle from the die, the injection unit including the heating barrel, the screw arranged in the heating barrel capable of being driven in the axial and radial direction and the drive unit for driving the screw must be moved each time of coating, that is, each shot. Then, the shot cycle is extended and the productivity is deteriorated. Further, even when the shot cycle is sacrificed to some extent, since the temperature of the die for making a part is about 200° C., that is, the temperature of the die for making a part is high, when the powder lubricant supply nozzle is frequently contacted with and separated from the die of high temperature, there is a possibility that the powder lubricant supply nozzle is damaged due to material fatigue. Further, the following problems may be encountered. The powder lubricant is supplied via a flexible hose, and the temperature of this flexible hose becomes relatively high. Therefore, wax contained in the powder lubricant for enhancing the effect of adhesion of the releasing agent to the cavity is melted and adheres to the inside of the hose, which blocks the flow of the powder lubricant in the hose. For the above reasons, it is impossible to apply the method of coating the powder lubricant of the die casting machine 50 to the metal injection molding machine.

SUMMARY OF INVENTION

The present invention has been accomplished in view of the above circumstances. It is an object of the present invention to provide a method of coating a powder lubricant in a metallic injection molding machine and also it is an object of the present invention to provide a die used for metallic injection molding, characterized in that: it is unnecessary to move the injection unit each time the powder lubricant is coated so that the shot cycle can be shortened and power rates can be reduced. In addition to the above object, it is an object of another invention to provide a method of coating a powder lubricant in a metallic injection molding machine and also it is an object of another invention to provide a die used for metallic injection molding, characterized in that: solid particles of a powder lubricant, which are excellent because there is no possibility of evaporation, are uniformly coated in the cavity.

The above object of the present invention can be accomplished by the structure in which a recess is provided in the movable die and a powder lubricant is supplied form this recess. In the case of a die to which an open type injection nozzle is applied, there is provided a cold plug catcher for receiving a cold plug in the case of injection. Therefore, in order to accomplish the above object, a powder lubricant is supplied form the cold plug catcher. In order to accomplish the above object, the invention provides a method of coating a powder lubricant in a metallic injection molding machine having a die composed of a stationary die and a movable die, a sprue hole, runner groove, gate hole and cavity being formed on parting faces of these dies, a recess communicating with the sprue hole when the movable die is fastened to the stationary die being formed in the movable die, the method of coating a powder lubricant in a metallic injection molding machine comprising the step of coating the powder lubricant from the recess toward the cavity by decompressing the inside of the sprue hole, runner groove, gate hole and cavity from the cavity side. According to the invention, the recess is a cold plug catcher to catch a cold plug in the case of injecting molten metal. The invention provides a die used for metallic injection molding comprising: a stationary die; and a movable die, wherein a sprue hole, runner groove, gate hole and cavity are formed on parting faces of these dies, molten metal is injected into the cavity via the sprue hole and runner groove so as to fill the cavity with the molten metal, a recess communicating with the sprue hole when the movable die is fastened to the stationary die is formed in the movable die, a powder lubricant supply path provided in the movable die is communicated with the recess via a first opening and closing valve, and an exhaust gas path provided in the movable die is communicated with the cavity via a second opening and closing salve. The invention provides a die used for metallic injection molding, wherein the recess is a cold plug catcher, and the first and the second opening and closing valve are shut-off pins respectively arranged in the powder lubricant supply path and the exhaust path being freely moved in the axial direction. The invention provides a die used for metallic injection molding, wherein the exhaust path is communicated with the cavity via an overflow.

DETAILED DESCRIPTION OF PREFERRED EMBODIMENTS

In the present invention, the melting point of which is not higher than 700° C., or an alloy based on the metal element. Specific examples of the metallic raw material are: aluminum, magnesium, zinc, tin, lead, bismuth, terbium, tellurium, cadmium, thallium, astatine, polonium, selenium, lithium, indium, sodium, potassium, rubidium, caesium, francium, and gallium. In particular, it is preferable to use a simple substance of aluminum, magnesium, lead, zinc, bismuth or tin, and an alloy based on one of the above elements. The aforementioned metallic raw materials are metallic elements or alloys which are melted in the heating barrel by the heat given from the outside and injected into a cavity formed in the die so that it can be molded into a product. The melting point of copper is 1085° C. which is much higher than 700° C., however, the melting point of copper alloy used for soldering is lower than 700° C. Therefore, copper alloy is one of the objective metallic raw materials of the present invention. Further, one of the objective metallic raw materials of the present invention is a material to form a metallic compound material to which ceramic particles or ceramic fibers such as $Al_2O_3$ or SiC are simultaneously added.

These metallic raw materials can be provided by various methods. For example, it is possible to use a method in which an ingot is cut into chips by a chipping machine. Alternatively, it is possible to use a method in which turning chips obtained when cutting is conducted by a cutting machine are utilized. Further, it is possible to use a method in which molten metal is dripped into coolant such as water. Metallic raw materials obtained by these methods are formed into appropriately small shapes which are different from powder. Therefore, they can be easily handled and melted in the heating cylinder.

Figure 1:
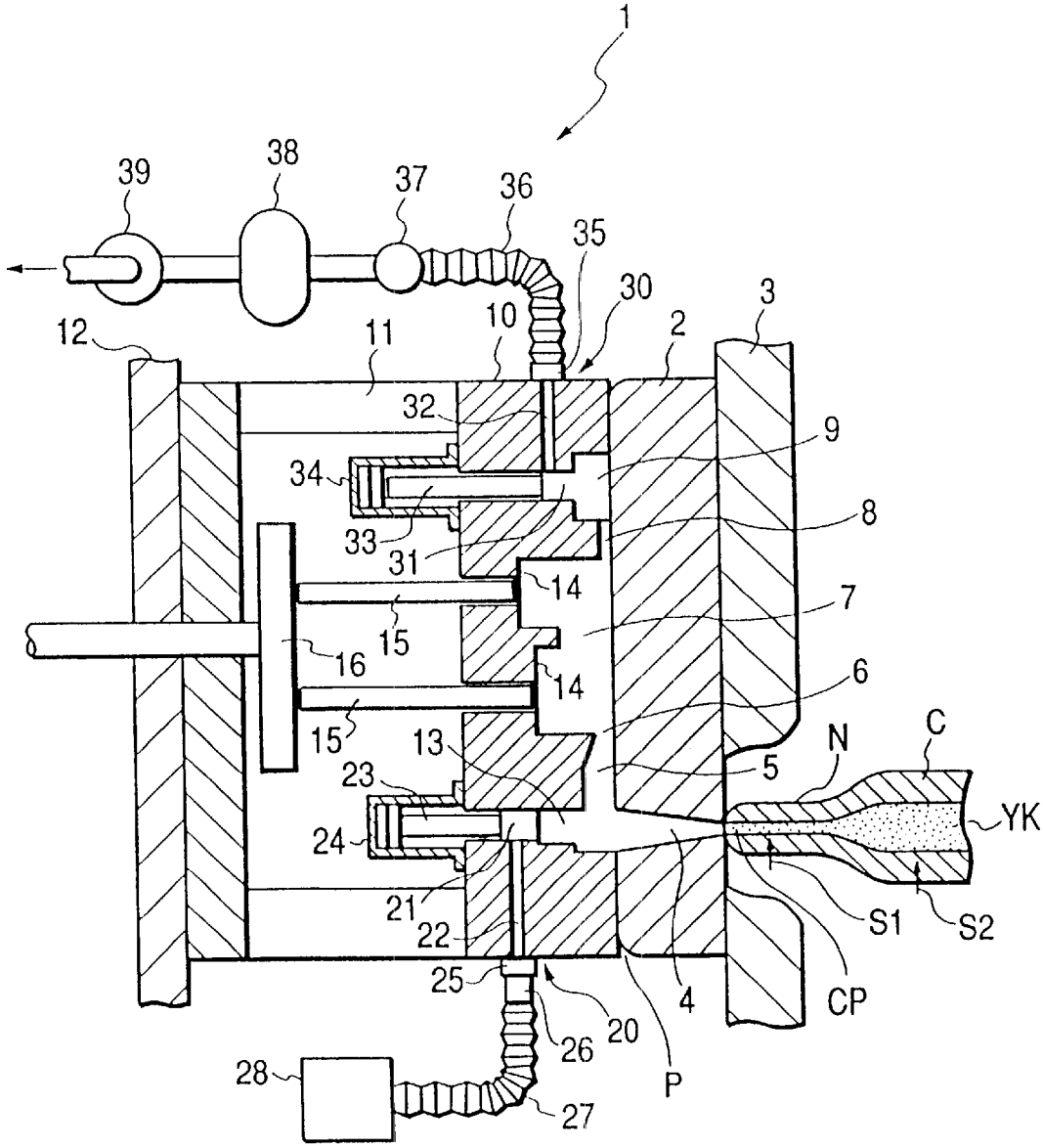
FIG. 1 is a cross-sectional view showing a die used for metallic injection molding of an embodiment of the present invention.

FIG. 1 is a cross-sectional view showing a die 1 used for metallic injection which is in a closed state, and this die 1 is an embodiment of the present invention. As shown in the drawing, the die 1 used for metallic injection of the embodiment includes: a stationary die 2 attached to the stationary side base 3; and a movable die 10 attached to the movable side base 12 via the slide base 11, wherein the movable die 10 is driven in the mold opening direction and the mold closing direction. In the movable die 10, there are provided a powder lubricant supply passage 20 and an exhaust passage 30.

In the stationary die 2, there are provided a conventionally known tapered sprue hole 4 which is formed crossing the stationary die 2. Along the parting face P between the stationary die 2 and the movable die 10, there are provided a runner groove 5, gate hole 6 and cavity 7 for forming a part, and they are communicated with the sprue 4. At an end portion of the cavity 7, there is provided an overflow 9, the capacity of which is relatively small, communicated with the cavity 7. There is provided an injection unit under the condition that an open type injection nozzle N can be touched with the sprue hole 4 of the stationary die 2 composed as described above. As conventionally known, the injection unit includes: a heating barrel C; an injection nozzle N arranged at the forward end of this heating barrel C; a screw arranged in the heating barrel C being driven in the radial and the axial direction; and a drive unit for driving this screw. In this connection, a plurality of heaters composed of electric heaters are provided in the outer peripheral sections of the injection nozzle N and the heating barrel C. Temperatures of these heaters are measured by the first temperature sensor S1 and the second temperature sensor S2. Temperatures of the injection nozzle N and the heating barrel C are individually controlled by a control unit to predetermined values. Neither the control unit nor the heater is shown in FIG. 1.

In the movable die 10, the dimensions of which are substantially the same as those of the stationary die 2, there is provided a cold plug catcher 13 of a predetermined depth and size corresponding to the sprue hole 4 of the stationary die 2, and this cold plug catcher 13 is substantially perpendicular to the parting face P. In this connection, on the parting face P of the movable die 10, there are formed a plurality of recesses, the sizes and depths of which are predetermined. By these recesses and the parting face P of the stationary die 2, the runner groove 5, gate hole 6, cavity 7 and overflow 9 are formed as described before. At the bottom portion 14 of the cavity 7, there are formed a plurality of through-holes which penetrate this bottom portion 14. The ejector pins 15, 15 are detachably inserted into these through-holes. As conventionally known, these ejector pins 15, 15 are attached to the ejector plate 16 driven by a hydraulic piston barrel unit.

In this embodiment, the powder lubricant supply passage 20 arranged in the movable die 10 includes: a first supply passage 21; and a second supply passage 22 which branches from the first supply passage 21 and is open onto the side of the movable die 10. One end portion of the first supply passage 21 is open to the bottom section of the cold plug catcher 13, and the other end portion of the first supply passage 21 is open to the rear portion of the movable die 10 on the left in FIG. 1. In this first supply passage 21, there is provided a shut-off pin 23 which is driven in the axial direction by the first hydraulic piston barrel unit 24 attached to the movable die 10. Accordingly, when the shut-off pin 23 is driven to the first retraction position shown in FIG. 1, the cold plug catcher 13 and the second supply passage 22 are communicated with each other via the first supply passage 21. However, when the shut-off pin 23 is driven to the second position by the first hydraulic piston and cylinder unit 24 so that the forward end portion of the shut-off pin 23 can reach the bottom portion of the cold plug catcher 13, the cold plug catcher 13 and the second supply passage 22 are shut off from each other. To the side of the movable die 10, the connector 25 is attached corresponding to the second supply passage 22, and the flexible hose 27 is connected with this connector 25 via the heat insulating pipe 26 made of ceramics. To this hose 27, the powder lubricant supply device 28 is connected which discharges a predetermined quantity of solid particles of the powder lubricant by compressed air.

The exhaust passage 30 is formed in the movable die 10. The exhaust passage 30 is composed of a first exhaust passage 31 and a second exhaust passage 32 which branches from this first exhaust passage 31 and is open to the side of the movable die 10, that is, open to the upper portion of FIG. 1. One end portion of the first exhaust passage 31 is open to the bottom portion of the overflow 9, and the other end portion is open to the rear portion of the movable die 10 on the left of FIG. 1. In this first exhaust passage 31, there is provided a shut-off pin 33 which is driven in the axial direction by the second hydraulic piston and cylinder unit 34. Accordingly, when the shut-off pin 33 is driven to the first retracting position shown in FIG. 1, the overflow 9 and the second exhaust passage 32 are communicated with each other via the first exhaust passage 31. However, when the shut-off pin 33 is driven to the second position by the second hydraulic piston and cylinder unit 34 so that the forward end portion of the shut-off pin 33 can reach the bottom portion of the overflow 9, the overflow 9 and the second exhaust 32 are shut off from each other. Outside the movable die 10, the flexible holes 36 is connected with the second exhaust passage 32 by the connector 35. This flexible holes 36 is connected with the opening and closing valve 37 for assisting the closeness of the first 31 and the second exhaust passage 32, the vacuum tank 38 of a relatively large capacity and the exhaust pump 39 which are arranged in this order.

Next, an example of molding operation, in which the die 1 for metallic injection molding of this embodiment is used, will be explained below. In this connection, it possible to conduct molding automatically by the die 1 for metallic injection molding of this embodiment when a control unit is provided. However, in order to simplify the explanation, an example of manual operation of the die 1 for metallic injection molding will be explained here. Although the die clamping system is not shown in FIG. 1, the movable die 10 is fastened to the stationary die 2. Metallic raw material is measured by the injection unit. The movable die 10 is clamped to the stationary die 2 and cold plug CP is formed at the forward end of injection nozzle N, and a predetermined quantity of molten metal YK is measured in the measuring heating barrel C. This state is shown in FIG. 1. The shut-off pins 23, 33 are moved to the first retracting positions by the first 24 and the second hydraulic piston and cylinder unit 34 as shown in FIG. 1, and then the opening and closing valve 37 is opened and the exhaust pump 39 is driven. When the opening and closing valve 37 is opened, air is discharged from the overflow 9, cavity 7, runner groove 5 and sprue hole 4 into the vacuum tank 38. Therefore, the overflow 9, cavity 7, runner groove 5 and sprue hole 4 are decompressed. The powder lubricant is supplied from the powder lubricant supply device 28 by compressed air. The powder lubricant passes through the holes 27, second supply passage 22 and first supply passage 21 and adheres to the surfaces of the cold plug catcher 13, sprue hole 4, runner groove 5, cavity 7 and overflow 9. When a predetermined quantity of powder lubricant has been coated or alternatively when the powder lubricant has been coated for a predetermined period of time, the coating of the powder lubricant is completed.

The cold plug catcher 13, which is a supply port of the powder lubricant, is recessed by a predetermined depth from parting face P. Therefore, the redundant powder lubricant stays in the cold plug catcher 13. That is, there is no possibility that the redundant powder lubricant flows to the cavity 7 at random and gets involved in the part. The sprue hole 4 is recessed with respect to a flow of air containing the powder lubricant. Accordingly, a relatively large quantity of powder lubricant is coated in the sprue hole 4. Due to the foregoing, even the long sprue, the drawing resistance of which is high, can be easily drawn out. The flexible hose 27 is connected with the second supply passage 22 via the heat insulating hose 26. Accordingly, there is no possibility that the flexible hose 27 is heated to high temperatures. Accordingly, there is no possibility that wax in the powder lubricant is melted and adheres onto the inner face of the flexible hose 27.

Figure 2A:
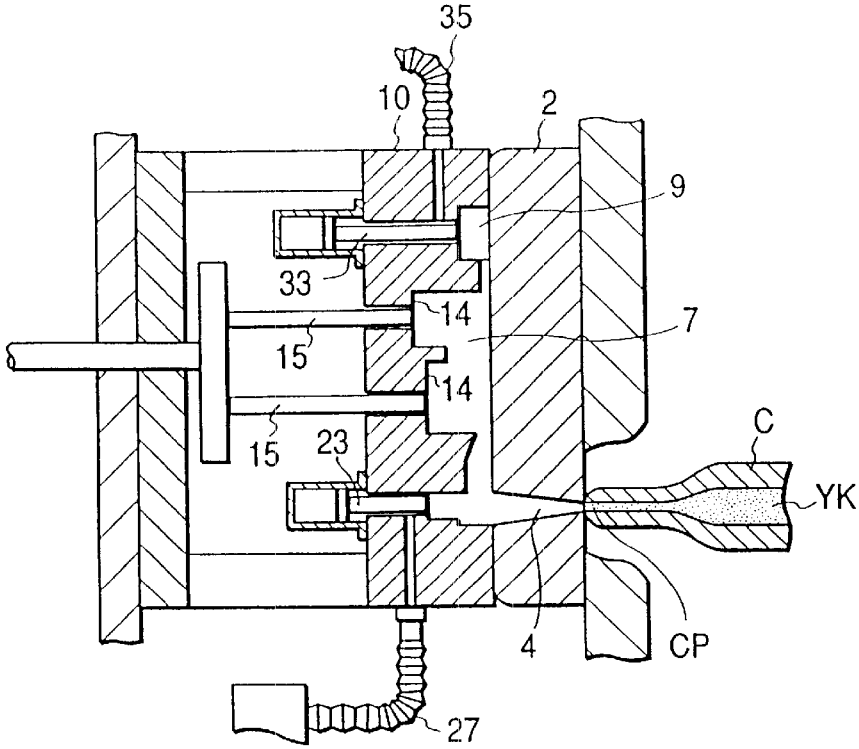
FIGS. 2(*a*) and 2(*b*) are views showing a molding process in which a die used for metallic injection molding of an embodiment of the present invention is used, wherein FIG. 2(*a*) is a cross-sectional view showing a state in which the movable die is closed and injection can be conducted, and FIG. 2(*b*) is a cross-sectional view showing a state in which injection and charging have been completed.
Figure 2B:
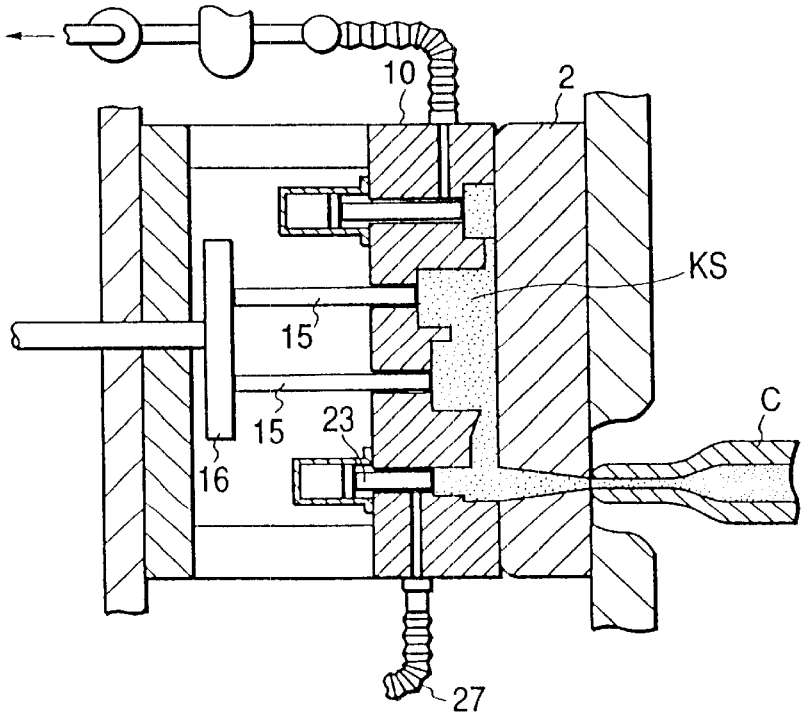
Figure 3:
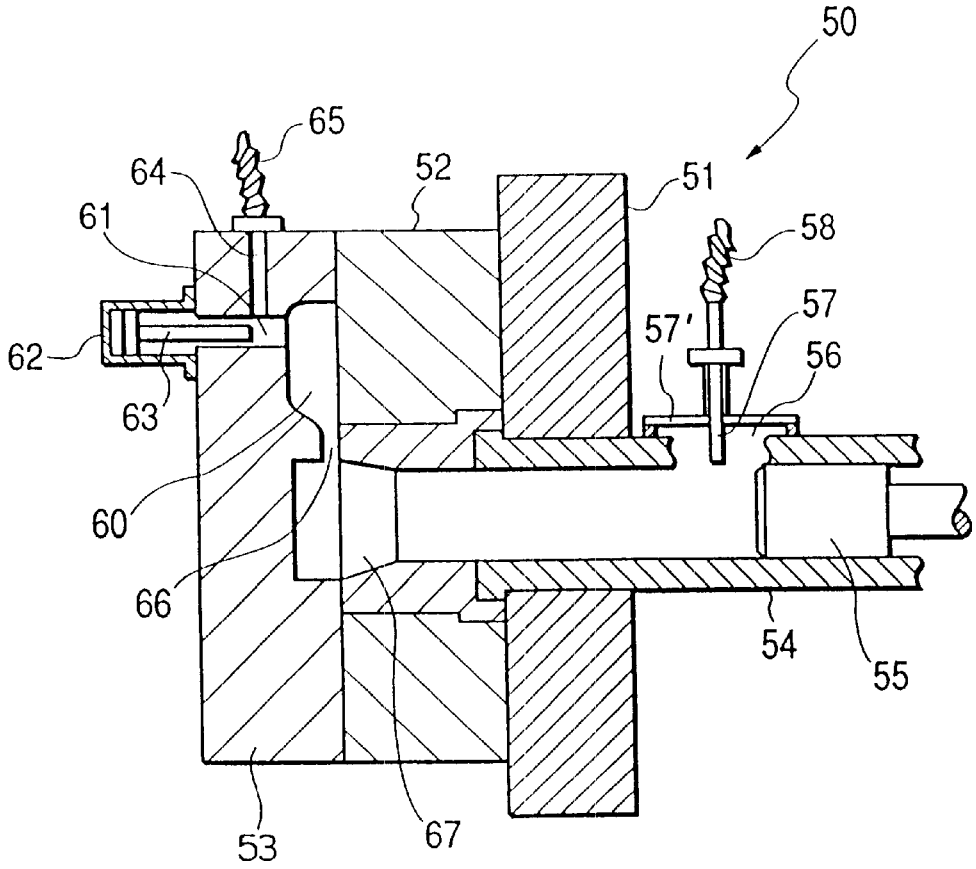
FIG. 3 is a cross-sectional view a conventional die casting machine.

The opening and closing valve 37 is closed, and at the same time the shut-off pins 23, 33 are driven to the second positions by the first 24 and the second hydraulic piston and cylinder unit 34 so that the forward end portions of the respective shut-off pins 23, 33 can reach the bottom portions of the cold plug catcher 13 and the overflow 9. Due to the foregoing, the first supply passage 21 and the first exhaust passage 31 are closed, and injection can be conducted on this die. This state is shown in FIG. 2(*a*).

While injection nozzle N is kept touched with the stationary die 2, the screw of the injection unit is driven in the axial direction, so that the measured molten metal YK is injected. Cold plug CP is received by the cold plug catcher 13, and molten metal YK passes through the sprue hole 4, runner groove 5 and gate hole 6 and is charged into the cavity 7. Redundant molten metal YK reaches the overflow 9 via the small hole 8. FIG. 2(*b*) is a view showing a state in which charging of molten metal has been completed. Then, pressure in the die is kept in the conventional manner. After the thus charged molten metal YK has been cooled and solidified, or alternatively when the screw is rotated after injection and measurement are completed, the movable die 10 is opened. Then, the ejector pins 15, 15 are protruded from the movable die 10, and part KS is pushed out together with the sprue, runner and overflow. Next, the movable and the stationary die are clamped to each other.

The shut-off pins 23, 33 are driven to the first retracting positions by the first 24 and the second hydraulic piston and cylinder unit 34. As described before, the cavity 7 and others are decompressed, and the powder lubricant is coated for a predetermined period of time. Due to the foregoing, the die is ready to be transferred to the next shot cycle. In the same manner as that described above, molding is conducted.

The present invention is not limited to the above specific embodiment. It is possible to make variations as follows. For example, with respect to the injection nozzle in which a shut-off valve is attached to injection nozzle N, it is possible to use a cold plug catcher 13 formed into a simple recess. The first 24 and the second hydraulic piston and cylinder unit 34 may be replaced with pneumatic piston and cylinder units. Since the shut-off pins 23, 33 driven by the first 24 and the second hydraulic piston and cylinder unit 34 are substantially synchronously moved to the first and the second position, the first 24 and the second hydraulic piston and cylinder unit 34 may be replaced with one hydraulic piston and cylinder unit. In the present embodiment, the first 24 and the second hydraulic piston and cylinder unit 34 are attached to the movable die 1, however, it is possible to attached the first 24 and the second hydraulic piston and cylinder unit 34 to the ejector plate 16. When the above arrangement is adopted, the following advantages can be provided. When the ejector pins 15, 15 are protruded, the shut-off pins 23, 33 are also respectively protruded from the bottom portions of the cold plug catcher 13 and overflow 9, so that part KS can be more easily pushed out. It is clear that the valve mechanism for opening and closing the first supply passage 21 is not limited to the shut-off pin 23. Further, it is clear that the first exhaust passage 31 can be arranged in a portion except for the overflow 9, for example, the first exhaust passage 31 can be arranged at an end portion of the cavity 7.

As described above, the present invention provides a method of coating a powder lubricant in a metallic injection molding machine having a die composed of a stationary die and a movable die, a sprue hole, runner groove, gate hole and cavity being formed on parting faces of these dies, a recess communicating with the sprue hole when the movable die is fastened to the stationary die being formed in the movable die, the method of coating a powder lubricant in a metallic injection molding machine comprising the step of coating the powder lubricant from the recess toward the cavity by decompressing the inside of the sprue hole, runner groove, gate hole and cavity from the cavity side. Therefore, it is unnecessary to move the injection nozzle each time the powder lubricant is coated. According to the present invention, there is no possibility that the shot cycle is extended and the productivity is deteriorated. It is unnecessary to move the injection nozzle, that is, it is unnecessary to move the injection unit at each shot. Therefore, the electric power rates are not increased. In the die to which an open type injection nozzle is applied, there is provided a cold plug catcher. Therefore, according to another invention, the plug catcher of which is formed in such a manner that the recess is communicated with the sprue hole, the effect of the present invention can be further enhanced. Since the plug catcher is formed in such a manner that the recess is communicated with the sprue hole, a large quantity of powder lubricant is coated in the sprue hole, the longitudinal length of which is long and the mold releasing resistance of which is high. Therefore, the obtained part can be easily pushed out by the thus coated powder lubricant. It is designed that the slurry molten metal flows uniformly into the cavity via the sprue hole and runner groove. However, according to another invention, the powder lubricant is coated from the cold plug catcher, which is communicated with the sprue hole, to the cavity. Therefore, the powder lubricant flows in the same manner as that of molten metal and is uniformly coated on the cavity surface.

What is claimed is:

1. A method of coating a powder lubricant in a metallic injection molding machine including a die including a stationary die and a movable die, a sprue hole formed in the stationary die, a runner groove, a gate hole and a cavity being formed on parting faces of these dies, a cold plug catcher in the form of a recess communicating with the sprue hole when the movable die is clamped to the stationary die, the cold plug catcher being formed in the movable die, comprising the steps of:

decompressing the inside of the sprue hole, the runner groove, the gate hole and the cavity; and introducing the powder lubricant, via the cold plug catcher, into the sprue hole, the runner groove, the gate hole and the cavity, and coating the powder lubricant on the inside of cold plug catcher the sprue hole, the runner groove, the gate hole and the cavity.

2. A die used for metallic injection molding comprising:

a stationary die; and a movable die, a sprue hole, a runner groove, a gate hole and a cavity formed on parting faces of at least one of the stationary die and the movable die, molten metal being injected into the cavity via the sprue hole and the runner groove so as to fill the cavity with the molten metal;

a cold plug catcher in form of a recess formed in the movable die, the cold plug catcher communicating with the sprue hole when the movable die is clamped to the stationary die;

a powder lubricant supply path provided in the movable die, the powder lubricant supply path being communicated with the sprue hole via the cold plug catcher a first opening and closing valve, for facilitating the introduction of powder lubricant into the cold plug catcher and the cavity; and an exhaust gas path, provided in the movable die, communicated with the cavity via a second opening and closing valve.

3. A die used for metallic injection molding according to claim 3, wherein the first and the second opening and closing valve are shut-off pins respectively arranged in the powder lubricant supply path and the exhaust path being freely moved in the axial direction.

4. A die used for metallic injection molding according to claim 2, wherein the exhaust path is communicated with the cavity via an overflow.

5. A die used for metallic injection molding according to claim 3, wherein the exhaust path is communicated with the cavity via an overflow.

* * * * *